US010676908B2

(12) United States Patent
Kashirajima et al.

(10) Patent No.: US 10,676,908 B2
(45) Date of Patent: Jun. 9, 2020

(54) FLUSH TOILET

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuuki Shinohara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 15/808,248

(22) Filed: Nov. 9, 2017

(65) Prior Publication Data

US 2018/0135289 A1 May 17, 2018

(30) Foreign Application Priority Data

Nov. 16, 2016 (JP) ..... 2016-223228

(51) Int. Cl.
*E03D 11/08* (2006.01)

(52) U.S. Cl.
CPC ..... *E03D 11/08* (2013.01); *E03D 2201/30* (2013.01); *E03D 2201/40* (2013.01)

(58) Field of Classification Search
CPC ..... E03D 11/02; E03D 11/06; E03D 11/08; E03D 11/13; E03D 2201/40
USPC .... 4/420, 421, 425, 430, 429, 440, 329, 442
See application file for complete search history.

(56) References Cited

U.S. PATENT DOCUMENTS 196,798 A * 11/1877 Harrison ..... E03D 11/02 4/420
2013/0047326 A1* 2/2013 Yamasaki ..... E03D 11/08 4/345
2013/0047328 A1 2/2013 Yamasaki et al.
2014/0289947 A1* 10/2014 Hirakawa ..... E03D 11/08 4/421

FOREIGN PATENT DOCUMENTS

| | | | |
|---|---|---|---|
| JP | 2000-265525 | A | 9/2000 |
| JP | 2007-314975 | A | 12/2007 |
| JP | 2013-044178 | A | 3/2013 |
| JP | 2013-170425 | A | 9/2013 |
| JP | 5592617 | B2 | 9/2014 |
| JP | 2016-041880 | A | 3/2016 |

OTHER PUBLICATIONS

An Office Action; "Notice of Reasons for Rejection," mailed by the Japanese Patent Office dated Aug. 7, 2017, which corresponds to Japanese Patent Application No. 2016-223228; with English language Concise Explanation.
An Office Action issued by the Japanese Patent Office dated Dec. 11, 2017, which corresponds to Japanese Patent Application No. 2016-223228 and is related to U.S. Appl. No. 15/808,248.

* cited by examiner

*Primary Examiner* — Erin Deery
(74) *Attorney, Agent, or Firm* — Studebaker & Brackett PC

(57) ABSTRACT

A flush toilet comprises a bowl including a shelf formed on the top edge of a bowl-shaped waste receiving surface, and a rim forming an inner wall surface rising from the outside (Continued)

edge of this bowl; and a rim spout portion for spouting flush water to the inside of the bowl. The rim spout portion is disposed on the bowl rim and forms a single rim spout port over the entire perimeter of the rim for spouting flush water, and the rim spout port is disposed on either the left or right of the front side region, and spouts flush water rearward. The region to the side of the rim spout port in the inner wall surface forms a continuous band over the entire bowl perimeter.

4 Claims, 4 Drawing Sheets

FLUSH TOILET

TECHNICAL FIELD

The present invention relates to a flush toilet, and more particularly to flush toilet configured to discharge waste by flushing the flush toilet with flush water supplied from a flush water source.

BACKGROUND

Conventionally, known flush toilets in which waste is discharged by flushing with flush water supplied from a flush water source have included those such as cited in Patent Document 1 (Japanese Patent Unexamined Publication No. 2007-314975), in which a rim spout port for spouting flush water into a bowl is disposed close to the front end of the bowl interior, or in Patent Document 2 (Japanese Patent Unexamined Publication No. 2016-41880), in which a rim spout port is disposed at the back of a bowl interior.

Also known, as noted in Patent Document 3 (Japanese Patent Publication No. 5592617), is a toilet in which a rim spout port is disposed at on the side and at a position midway along the front-rear direction inside a bowl, or the rear thereof, such that water is spouted toward the rear inside the bowl.

However in the conventional flush toilet in the above-described Patent Documents 1-3, the shape of the region around the rim spout port tends to become complex. This can therefore lead to a degradation in design characteristics, such as the perimeter of the rim spout portion being placed in shadow.

In particular, in the conventional flush toilet set forth in the above-described Patent Document 1, the front region in the bowl where the rim spout port is disposed has a complex shape. This raises the problem that the rim spout port comes into the view of a user seated on the toilet seat with somewhat spread apart legs, thereby reducing aesthetic appearance.

Also, in the conventional flush toilet set forth in the above-described Patent Documents 2 and 3, the rear region of the bowl where the rim spout port is disposed has a complex shape. It therefore comes into the field of view of a user standing in front of the toilet main unit or crouching, which raises the problem of degraded aesthetic appearance.

In addition, in the conventional flush toilet set forth in the above-described Patent Documents 1 through 3, if aesthetic appearance of the rim spout port surrounding shape is overemphasized, it becomes difficult to maintain the bowl flushing performance of the flush water spouted from the rim spout port. There has thus been a need to satisfy both flushing performance and aesthetic appearance.

SUMMARY

The present invention was thus undertaken to solve the problems and issues with the conventional art described above, and has the object of providing a flush toilet capable of easily concealing the rim spout port and providing a flush toilet or superior aesthetic appearance, while maintaining bowl flushing characteristics.

To solve the above-described problems, the present invention provides a flush toilet configured to discharge waste by flushing the flush toilet with flush water supplied from a flush water source. The flush toilet comprises a bowl including a bowl-shaped waste receiving surface, a shelf formed on a top edge of the waste receiving surface, and a rim including an inner wall surface configured to rise from an outside edge of the shelf. The flush toilet also comprises a rim spout portion configured to spout flush water onto the shelf in the bowl.

The bowl includes a front side region and a rear side region. The front side region is formed on a front side of a center axis extending horizontally in a left-right direction of the bowl so as to divide the bowl equally in a front-rear direction of the bowl. The rear side region is formed on a rear side of the center axis. The rim spout portion includes a rim spout port disposed on the rim of the bowl. The rim spout port is a single over an entire perimeter of the rim so as to spout the flush water. The rim spout port is disposed on either the left or right of the front side region so as to spout flush water rearward. The rim spout portion further includes a region of the inner wall surface located over the rim spout port is formed in a continuous band shape over an entire perimeter of the bowl.

According to the invention thus constituted, the rim spout port can be made less visible to a user positioned in front of and above the bowl, while maintaining cleanability of the bowl using flush water spouted rearward from the rim spout port.

Because the region above the single rim spout port in the inner wall surface of the rim is formed in a continuous band over the entire perimeter of the bowl, the rim spout port can be easily concealed. Thus a flush toilet with superior aesthetic appearance can be provided.

In addition, compared to the case when the rim spout port is formed on the front end of the bowl, the bowl front end is less prone to have a complex shape, and aesthetic appearance can be improved.

In the present invention, preferably, the rim spout port includes an opening end surface configured to be parallel to the center axis extending in the left-right direction. Normally, the more the rim spout port is concealed, the greater is the drop in visibility of the rim spout port during flushing.

According to the present invention, on the other hand, by arranging the opening end surface of the rim spout port to be parallel to the center axis extending in the left-right direction, the rim spout port can continue to be concealed when viewed from the user's side in front of and above the bowl. Also, rim spout port visibility improves when the gaze is lowered to a point close to the bowl when crouching to clean, etc., such that viewing is from the side on which no rim spout port is disposed, either on the left or right. Hence cleanability, such as the ability to reach the rim spout port with cleaning tools, can be improved.

Thus rim spout port concealing characteristics and cleanability can both be achieved.

In the present invention, preferably, the rim spout portion further includes a conduit on a downstream side of the rim spout port. The cross section of the conduit is formed by a shelf surface of the shelf, the inner wall surface rising from an outside edge of the shelf surface, and an overhang part formed on an upper part of the inner wall surface. The overhang part includes a sloped surface configured to slope obliquely upward from a bottom end of the overhang part and toward an inside of the bowl.

According to the invention thus constituted, concealment of the rim spout port seen by a user from the front and above the bowl can be maintained. In addition, the rim spout port becomes more visible when a user's gaze is lowered to the point of approaching the bowl vicinity, such as when crouching to clean, etc., therefore cleanability, such as the ability to reach the rim spout port with cleaning tools, can be improved.

Thus rim spout port concealing characteristics and cleanability can both be achieved.

In the present invention, the rim spout port is disposed on either a left or right side in the front side region of the bowl and is configured that a distance in the front-rear direction from a front end of the bowl to the rim spout port is 20% to 40% of a distance from the front end to a rear end of the bowl.

According to the invention thus constituted, the rim spout port can be more easily concealed as seen from the user side in front of and above the bowl, while maintaining cleanability of the bowl using flush water spotted rearward from the rim spout port. A flush toilet with superior aesthetic appearance can thus be provided.

Also, visibility of the rim spout port increases when the gaze is lowered to the bowl vicinity, such as when crouching down to clean, etc. Hence cleanability, such as the ability to reach the rim spout port with cleaning tools, can be improved.

Thus rim spout port concealing characteristics and cleanability can both be achieved.

With the flush toilet of the invention, the rim spout port is more easily concealed and superior aesthetic appearance is achieved, while bowl cleanability is maintained.

DETAILED DESCRIPTION

Next, referring to FIGS. 1-4, a flush toilet according to one embodiment of the invention is explained hereinafter.

Figure 1:
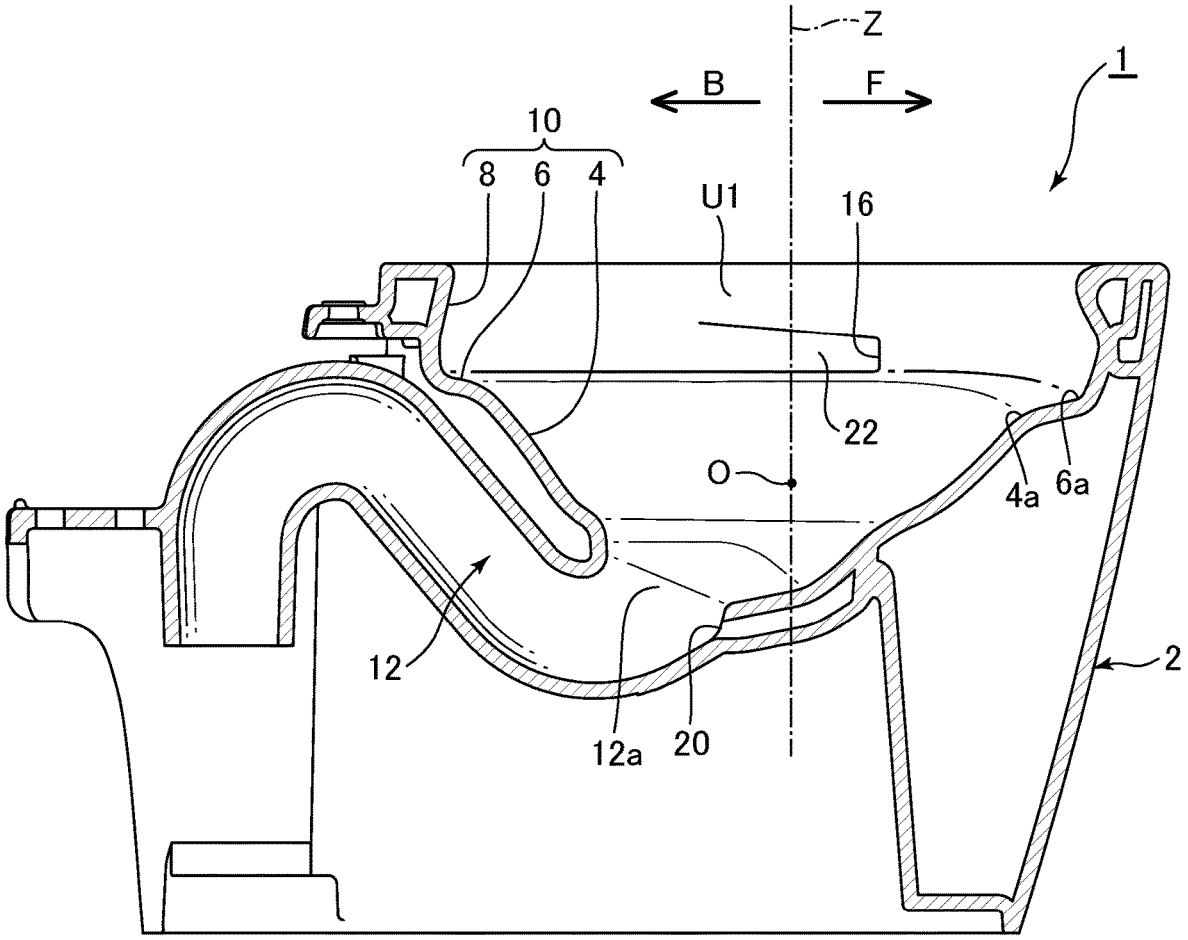
FIG. 1 is a center side elevation cross section of a flush toilet main unit of a flush toilet according to one embodiment of the invention.
Figure 2:
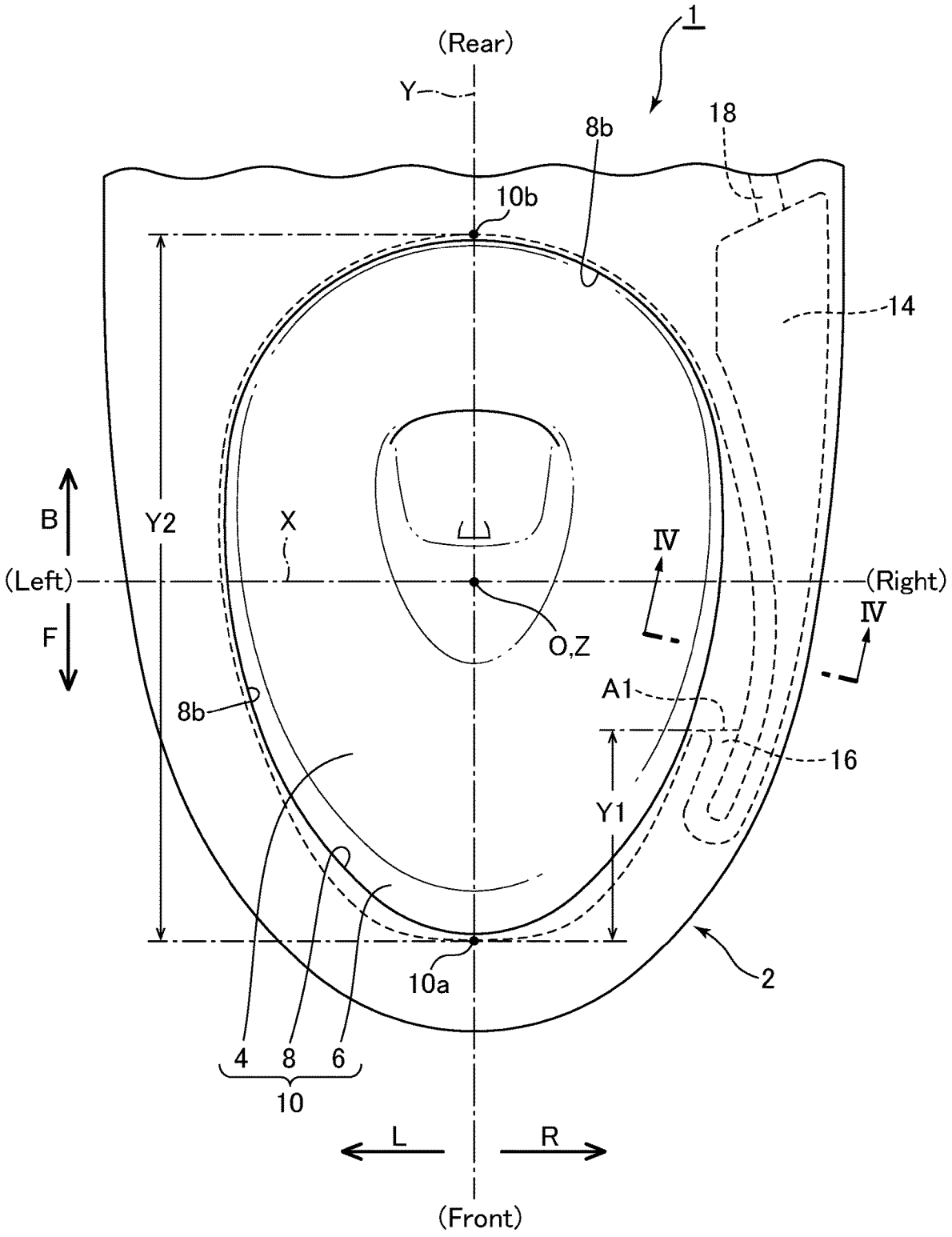
FIG. 2 is a plan view of the flush toilet main unit of the flush toilet according to the one embodiment of the invention.

First, FIG. 1 is a center side elevation cross section of the flush toilet main unit of the flush toilet according to the one embodiment of the invention. FIG. 2 is a plan view of the flush toilet main unit of the flush toilet according to the one embodiment of the invention.

Figure 3:
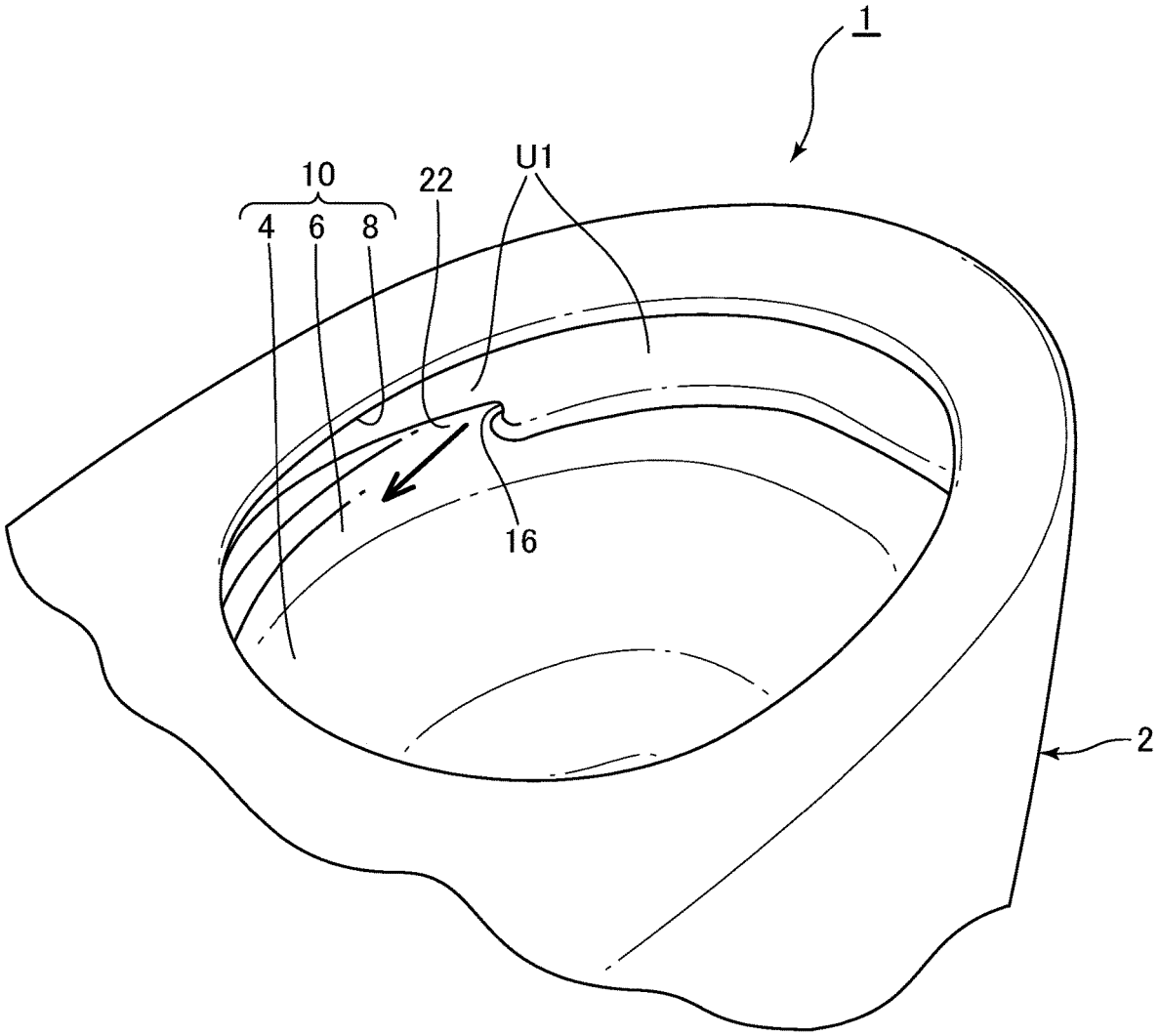
FIG. 3 is a perspective view seen diagonally from the rear of a flush toilet main unit of the flush toilet according to the one embodiment of the invention.
Figure 4:
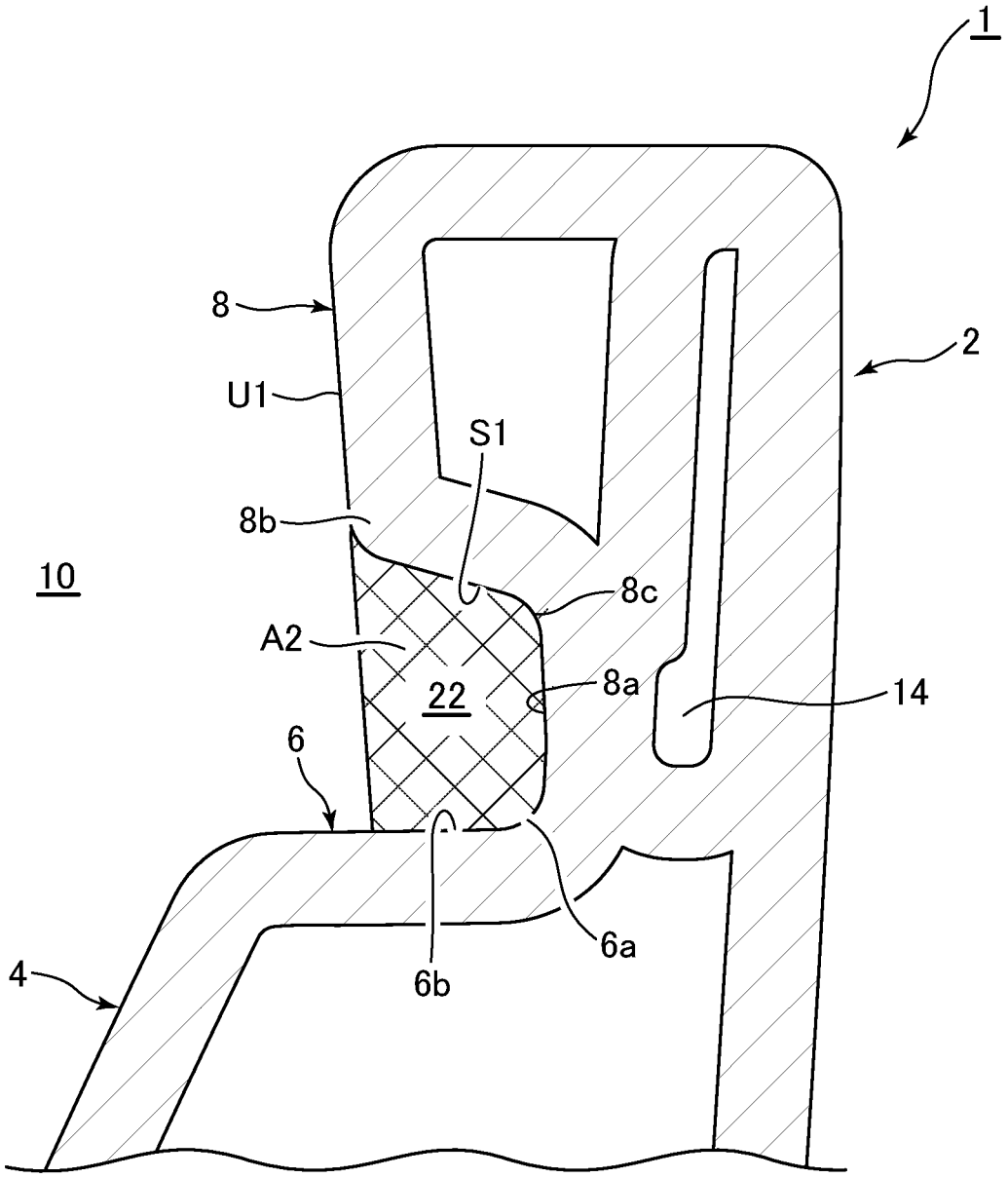
FIG. 4 is a cross section taken along line IV-IV in FIG. 2.

In addition, FIG. 3 is a perspective view seen diagonally from the rear of a flush toilet main unit of the flush toilet according to the one embodiment of the invention. FIG. 4 is a cross section taken along line IV-IV in FIG. 2.

First, as shown in FIGS. 1-3, the flush toilet 1 according to the one embodiment of the invention includes a toilet main body 2 made of ceramic. The toilet main body 2 may also be made of a material other than ceramic, such as resin.

In the embodied flush toilet 1 shown here in FIGS. 1-3, a toilet seat and toilet lid (not shown) are provided on the top surface of the toilet main body 2. A sanitary flush device for washing a user's private parts, and other functional devices, such as the water supply system that functions to supply water to the toilet main unit 2, are installed on the rear side of the toilet seat and toilet lid. Please note that these devices are not illustrated in the drawings, and an explanation thereof is omitted.

As shown in FIGS. 1 and 2, the toilet main unit 2 includes a bowl-shaped waste-receiving surface 4, a shelf 6, a rim 8, and a bowl 10. The shelf 6 is formed around the top edge 4*a* of the waste-receiving surface 4. The rim 8 is formed so as to rise from the outer edge 6*a* of the shelf 6.

In addition, as shown in FIG. 1, the toilet main unit 2 includes a discharge trap pipe 12. An inlet 12*a* on the discharge trap pipe 12 is connected to the bottom of the bowl 10, and serves as a discharge path for discharging waste in the bowl 10.

In the plan view of the bowl 10 of the toilet main unit 2, the flush toilet 1 according to the one embodiment of the invention shown in FIGS. 1 and 2 has a center axis identified by the letter "X" that extends horizontally in the left-right direction and equally divides the bowl 10 into front and rear parts. Also, the flush toilet 1 has a center axis identified by the letter "Y" that extends horizontally in the front-rear direction and equally divides the bowl 10 into left and right parts. In addition, the flush toilet 1 has a center axis identified by the letter "Z" that extends vertically and passes through a center O of the bowl 10.

Further, as shown in FIG. 2, the front, rear, left and right directions on the flush toilet 1 are respectively identified by the legends "front," "rear," "left," and "right."

As shown in FIGS. 1 and 2, the legends "front side region F" and "rear side region B" define for the front and rear sides of the flush toilet 1, respectively, with respect to the center O, the center axis X extending horizontally in the left-right direction, and the center axis Z extending vertically of the bowl 10 of the flush toilet 1.

In addition, as shown in FIG. 2, the legends "left side region L" and "right side region R" define the left and right sides of the flush toilet, respectively, as seen from the front, with respect to the center O and the center axis Y extending horizontally in the front-rear direction of the bowl 10 of the toilet 1.

As shown in FIGS. 1-3, a rim conduit 14 that performs a part of the functionality of the rim spout portion is formed on inside the right side region R and the front side region F of the bowl 10.

A single rim spout port 16 is formed at the downstream end of the rim conduit 14. The rim spout port 16 performs as a part of the functionality of the rim spout portion by spouting flush water rearward inside the bowl 10 to form a circulating flow.

That is, the rim spout portion comprises the single rim spout port 16 disposed in the rim 8 of the bowl 10 for spouting flush water throughout the entire circumference of the rim 8. The rim spout port 16 is disposed on the rim 8 in the right side region R and in the front side region F of the bowl 10, and spouts flush water rearward.

In addition, as shown in FIG. 2, the upstream side of the rim conduit 14 is directly connected to a water conducting pipe 18. The upstream side of this water conducting pipe 18 is directly connected to a utility water pipe (not shown), being the flush water source. With the piping configuration, the water supply pressure is utilized so that flush water supplied into the rim conduit 14 from the water conducting pipe 18 is directed forward within the rim conduit 14, and then guided inside and rearward over to the rim spout port 16 located downstream.

Flush water directed to the rim spout port 16 is spouted (rim spouted) toward rearward and circulated inside the bowl 10, thereby forming a circulating flow inside the bowl 10.

The flush toilet 1 of the present embodiment has been described, in which the rim conduit 14 is disposed inside the rim 8 in the right side region R of the bowl 10, and the single rim spout port 16 is opened in the inner periphery of the rim 8 in the front side region F and the right side region R of the bowl 10. However, it is to be noted that the present invention is not limited to the described embodiment, and other variations can be adopted in which the rim conduit 14 is disposed inside the rim 8 in the left side region L of the bowl 10, and the single rim spout port 16 is opened in the inner periphery of the rim 8 in the front side region F and left side region L of the bowl 10 so as to perform spouting (rim spouting) rearward from the rim spout port 16.

In addition, as shown in FIG. 1, a jet spout port 20 is formed at the bottom portion of the bowl 10. The jet spout port 20 is directed at the inlet 12*a* of the discharge trap pipe 12. With the configuration, spouting (jet spouting) from the water supply functional portion (not shown) is also effected from the jet spout port 20.

Note that in the flush toilet 1 according to the present embodiment, rim spouting by the rim spout port 16 is performed using the water supply pressure. Alternatively, "hybrid" form of flush toilet may be adopted in which a pressurizing pump (not shown) for jet spouting by the jet spout port 20 is used to supply flush water from a reservoir tank (not shown). It should be noted, however, that the invention is not limited to these configuration and other variations may also be adopted. For example, jet spouting by the jet spout port 20 may be dispensed with.

Next, referring to FIGS. 1-4, details of the rim spout port 16 and the rim 8 of the bowl 10 in the flush toilet 1 according to the one embodiment of the invention are explained as follows.

Also, as shown in FIG. 2, the single rim spout port 16 formed on the bowl 10 front side region F and right side region R inside perimeter side is disposed such that the distance Y1 in the front-rear direction from the front end 10*a* inside the bowl 10 to the rim spout port 16 is at a position 30% of the distance Y2 from the front end 10*a* to the rear end 10*b* of the bowl 10.

As shown in FIG. 2, the rim spout port 16 is formed so that its opening end surface A1 is formed to be parallel to the center axis X extending in the left-right direction of the bowl 10.

By this means, concealment of the rim spout port 16 seen from the user's side in front of and above the bowl 10 can be maintained. Also, the rim spout port 16 becomes more visible when a user's gaze is lowered to the point of approaching the bowl vicinity, such as when crouching to clean, etc., therefore cleanability, such as the ability to reach the rim spout port 16 with cleaning tools, can be improved.

Note that it is preferable for the distance Y1 in the front-rear direction from the front end 10*a* of the bowl 10 to the rim spout port 16 to be set from 20% to 40% of the distance Y2 from the front end 10*a* to the rear end 10*b* within the bowl 10, and most preferably to be set to between 25% to 35% thereof.

Next, FIG. 4 is a cross section taken along line IV-IV in FIG. 2.

As shown in FIGS. 1-4, a conduit 22, which also functions as part of the rim spout portion, is formed on the downstream side of the rim spout port 16.

Also, as shown in FIG. 4, the flow path cross section A2 of the conduit 22 is formed respectively by a shelf surface 6*b* of the shelf 6, an inner wall surface 8*a* of the rim 8 rising from the vicinity of the outside edge 6*a* of this shelf 6, and an overhang part 8*b* formed on the upper portion of this inner wall surface 8*a* of the rim 8. In addition, the overhang part 8*b* forms a sloped surface S1 sloping from the bottom end 8*c*, obliquely upward and toward the inside of the bowl 10.

Also, as shown in FIGS. 1-4, the region U1 above the rim spout port 16 in the inner wall surface 8*a* of the rim 8 is formed in a continuous band over the entire perimeter of the bowl 10.

Note that "band shape" here means, for example, a region spreading in a flat plane over a range broader than the size of the rim spout port 16 in the up-down direction.

Next the operation of the flush toilet 1 according to the above-described one embodiment of the invention will be explained.

First, in the flush toilet 1 according to the one embodiment of the invention, the rim spout portion is disposed on the rim 8 of the bowl 10 and forms the single rim spout port 16 over the entire perimeter of the rim 8 for spouting flush water; this rim spout port 16 spout is disposed on the rim 8 in the right side region R inside the front side region F, and spouts flush water rearward. The rim spout port 16 can therefore be made less visible to a user viewing from in front and above the bowl 10 or seated on the toilet seat (not shown), while maintaining flushing characteristics of the bowl 10 resulting from flush water spouted rearward from the rim spout port 16.

Also, the region U1 above the single rim spout port 16 in the inner wall surface 8*a* of the rim 8 is formed in a continuous band over the entire perimeter of the bowl 10. Thus the rim spout port 16 can be more easily concealed, and a flush toilet 1 with superior aesthetic appearance can be provided.

In addition, the front end 10*a* of the bowl 10 is less prone to have a complex shape, and aesthetic appearance can be improved compared to the case when the rim spout port 16 is formed on the front end 10*a* of the bowl 10.

Next, in a normal design, visibility of the rim spout port during flushing decreases as the rim spout port is more concealed. Using the flush toilet 1 of the present embodiment, however, the setting of the rim spout port 16 opening end surface A1 parallel with the center axis extending in the left-right direction of the bowl enables concealment of the rim spout port 16 as seen by a user in front of and above the bowl to be maintained. At the same time, rim spout port visibility improves when the gaze is lowered to a point close to the bowl when crouching to clean, etc., such that viewing is from the side on which no rim spout port is disposed, either on the left or right. Therefore cleanability, such as the ability to reach the rim spout port 16 with cleaning tools, can be improved.

Hence when the opening end surface is perpendicular to the direction in which flush water is spouted from the rim spout port (when the opening port end surface is tilted rearward from the outside of the bowl toward the center), concealment of the rim spout port is increased, and during cleaning the rim spout port cannot be seen without peering from the rear side of the bowl, so that cleanability is diminished. By comparison, in the present embodiment concealment and cleanability of the rim spout port 16 can both be achieved in the present embodiment.

Also, with the flush toilet 1 of the present embodiment, a conduit 22 is formed, which also functions as a part of the rim spout portion on the downstream side of the rim spout port 16. The flow path cross section A2 of the conduit 22 is formed respectively by the shelf surface 6*b* of the shelf 6, the inner wall surface 8*a* of the rim 8 rising from the vicinity of the outside edge 6*a* of this shelf 6, and the overhang part 8*b* formed on the upper portion of this inner wall surface 8*a* of the rim 8. Moreover, this overhang part 8*b* includes a sloped surface S1 sloping from the bottom end 8*c* obliquely upward and toward the inside of the bowl 10. Concealment of the rim spout port 16 seen from the user's side in front of and above the bowl 10 can thus be maintained.

Moreover, visibility of the rim spout port 16 increases when the gaze is lowered to the vicinity of the bowl 10, such as when crouching down to clean, etc. Therefore cleanability, such as the ability to reach the rim spout port 16 with cleaning tools, can be further improved.

Thus rim spout port 16 concealing characteristics and cleanability can both be achieved.

In addition, in the flush toilet 1 of the present embodiment the rim spout port 16 is disposed in the front side region F and the right side region R of the rim 8 on the bowl 10 so that the distance Y1 in the front-rear direction from the front end 10*a* of the bowl 10 to the rim spout port 16 is 20% to 40% of the distance Y2 from the front end 10*a* to the corner portion 10*b* of the bowl 10. The flushing performance in the bowl 10 by the flush water spouted rearward from the rim spout port 16 can thus be maintained. At the same time, the rim spout port 16 as seen by a user in front of and above the bowl 10 can be more easily concealed, and a flush toilet with superior aesthetic appearance provided.

Also, visibility of the rim spout port 16 also improves when the gaze is lowered to the vicinity of the bowl 10, such as when crouching down to clean, etc. Therefore cleanability, such as the ability to reach the rim spout port 16 with cleaning tools, can be improved.

Thus rim spout port 16 concealing characteristics and cleanability can both be achieved.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet configured to discharge waste by flushing the flush toilet with flush water supplied from a flush water source, the flush toilet comprising:

a bowl including a bowl-shaped waste receiving surface, a shelf formed on a top edge of the waste receiving surface, and a rim including an inner wall surface configured to rise from an outside edge of the shelf; and a rim spout portion configured to spout flush water onto the shelf in the bowl;

wherein the bowl includes a front side region and a rear side region, the front side region being formed on a front side of a center axis extending horizontally in a left-right direction of the bowl so as to divide the bowl equally in a front-rear direction of the bowl, the rear side region being formed on a rear side of the center axis, and the rim spout portion includes a rim spout port disposed on the rim of the bowl, the rim spout port being a single port so as to spout the flush water and the rim spout port being disposed on either the left or right of the front side region so as to spout flush water rearward;

the rim spout portion includes an overhang part having a first wall portion and a second wall portion in a vertical cross section view, wherein the first wall portion is configured to form an upper surface of the rim spout portion, and wherein the second wall portion is configured to connect an inner end of the upper surface of the rim spout portion and an inner end of an upper surface of the rim, and a wall surface of the second wall portion on a rear side of the rim spout port is flush with the inner wall surface of the rim formed on a front side of the rim spout port; and wherein a vertical width of the second wall portion is larger than a vertical width from the inner end of the upper surface of the rim spout portion to the shelf, wherein the rim spout portion further includes a conduit formed from the rim spout port toward a rearward of the bowl, wherein the second wall portion including the larger vertical width than the vertical width from the inner end of the upper surface of the rim spout port to the shelf is formed over a predetermined distance from the rim spout port toward a rear side of the conduit, and wherein an upper surface of the conduit is formed such that a horizontal width of the upper surface of the conduit continuously decreases from the rim spout port to the rear side of the conduit.

2. The flush toilet according to claim 1, wherein the rim spout port includes an opening end surface configured to be parallel to the center axis extending in the left-right direction.

3. The flush toilet according to claim 1, wherein the first wall portion of the overhang part includes a sloped surface configured to slope obliquely upward from a bottom end of the overhang part and toward an inside of the bowl.

4. The flush toilet according to claim 1, wherein the rim spout port is disposed on either a left or right side in the front side region of the bowl and is configured that a distance in the front-rear direction from a front end of the bowl to the rim spout port is 20% to 40% of a distance from the front end to a rear end of the bowl.

* * * * *